US009908328B2

(12) United States Patent
Goh et al.

(10) Patent No.: US 9,908,328 B2
(45) Date of Patent: Mar. 6, 2018

(54) ASSIGNING FIRING RESERVATIONS TO PRIMITIVES

(71) Applicant: HEWLETT-PACKARD DEVELOPMENT COMPANY, L.P., Houston, TX (US)

(72) Inventors: Guan Kwee Goh, Vancouver, WA (US); Michael Cumbie, Albany, OR (US); Garrett E Clark, Corvallis, OR (US); Duane Koehler, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/306,002

(22) PCT Filed: Apr. 25, 2014

(86) PCT No.: PCT/US2014/035405

§ 371 (c)(1),
(2) Date: Oct. 21, 2016

(87) PCT Pub. No.: WO2015/163904

PCT Pub. Date: Oct. 29, 2015

(65) Prior Publication Data

US 2017/0043578 A1 Feb. 16, 2017

(51) Int. Cl.
*B41J 2/045* (2006.01)

(52) U.S. Cl.
CPC ..... *B41J 2/04551* (2013.01); *B41J 2/0458* (2013.01); *B41J 2/04508* (2013.01); *B41J 2/04541* (2013.01); *B41J 2/04573* (2013.01); *B41J 2/04586* (2013.01)

(58) Field of Classification Search
CPC .. B41J 2/04545; B41J 2/0458; B41J 2/04581; B41J 2/04551; B41J 2/04586; B41J 2/04541; B41J 2/04508; B41J 2/04573
USPC ..... 347/14
See application file for complete search history.

(56) References Cited

U.S. PATENT DOCUMENTS

| | | | |
|---|---|---|---|
| 6,312,079 | B1 | 11/2001 | Anderson et al. |
| 6,431,686 | B2 | 8/2002 | Saul et al. |
| 7,104,624 | B2 | 9/2006 | Schloeman et al. |
| 7,168,167 | B2 | 1/2007 | Silverbrook |
| 8,517,490 | B2 | 8/2013 | Kanematsu et al. |
| 2002/0101602 | A1* | 8/2002 | Vilanova ..... G06K 15/107 358/1.14 |

(Continued)

FOREIGN PATENT DOCUMENTS

| | | |
|---|---|---|
| CN | 1454157 A | 11/2003 |
| EP | 1301351 | 9/2006 |
| WO | WO-2014040631 | 3/2014 |

OTHER PUBLICATIONS

Technology Overview, 2011-2014 Konica Minolta, Inc.; http://www.konicaminolta.com/inkjethead/technology/technology.html.

*Primary Examiner* — Huan Tran
*Assistant Examiner* — Alexander D Shenderov
(74) *Attorney, Agent, or Firm* — Brooks, Cameron & Huebsch, PLLC

(57) ABSTRACT

Assigning firing reservations to primitives can include assigning a plurality of firing reservations to each of the plurality of primitives and reassigning a firing reservation of the plurality of firing reservations from a primitive of the plurality of primitives to another primitive of the plurality of primitives.

18 Claims, 4 Drawing Sheets

(56) References Cited

U.S. PATENT DOCUMENTS

| | | | | |
|---|---|---|---|---|
| 2004/0223014 | A1* | 11/2004 | Barr | B41J 2/0451<br>347/12 |
| 2009/0096824 | A1 | 4/2009 | Bergstedt et al. | |
| 2010/0295897 | A1 | 11/2010 | Naruse | |

* cited by examiner

ASSIGNING FIRING RESERVATIONS TO PRIMITIVES

BACKGROUND

Printing devices are widely used and may include a printhead enabling formation of text or images on a print medium. Such a printhead may be included in an inkjet pen or printbar that includes channels that carry fluid. For instance, fluid may be distributed from a fluid supply to the channels through passages in a structure that supports the printhead(s) on the inkjet pen or printbar.

DETAILED DESCRIPTION

Figure 1:
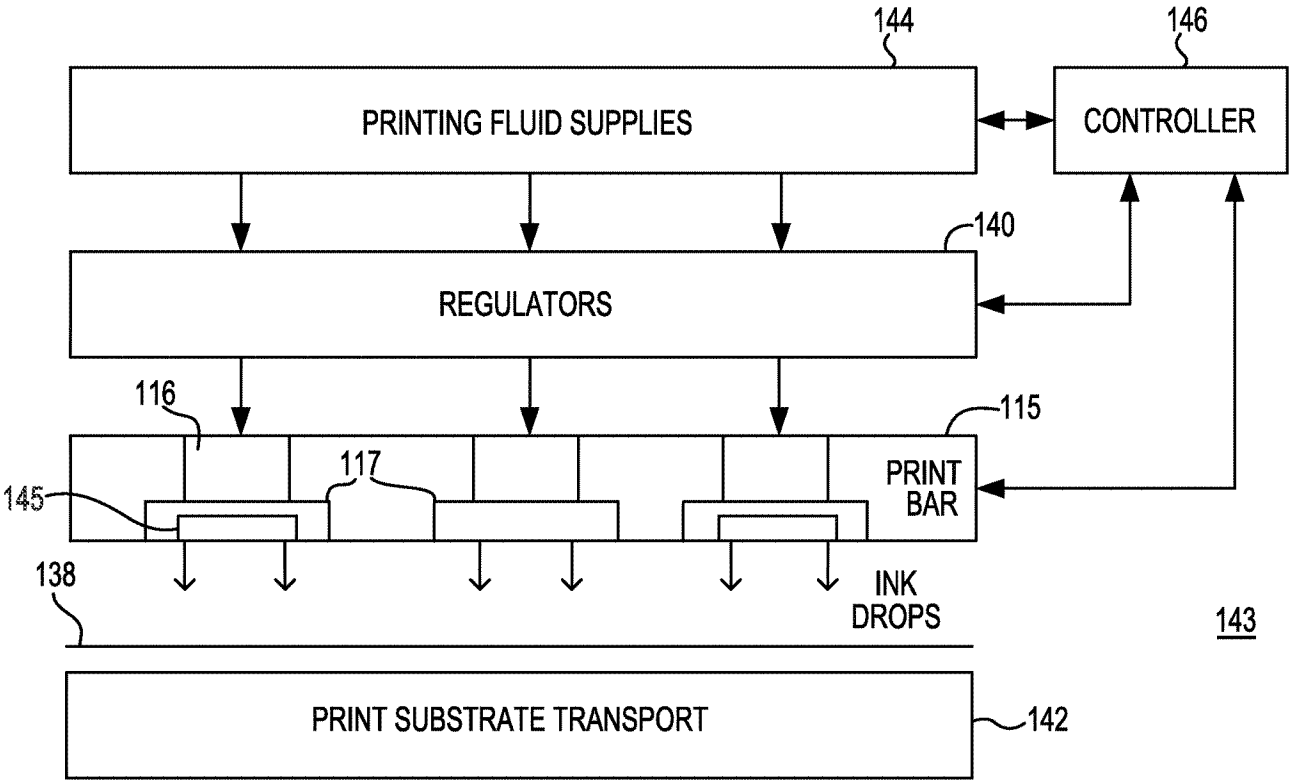
FIG. 1 is a block diagram illustrating a printer implementing an example of a printhead for assigning firing reservations to primitives according to the present disclosure.

Printers that utilize a printbar assembly (e.g., a substrate wide printbar assembly) have been developed to help increase printing speeds and reduce printing costs. Printbar assemblies often tend to include multiple parts that carry printing fluid from the printing fluid supplies to the printheads (e.g., printhead dies) from which the printing fluid is ejected on to the paper or other print substrate by control circuitry that provides data and/or power to the printhead. Generally, a printer can use a printhead (e.g., a printhead included in a printbar) including a plurality of nozzles (e.g., nozzle orifices) arranged in primitives to dispense fluid (e.g., ink). The location of a nozzle can be an address. An address can be a location of a nozzle in a primitive and/or on a printhead in general. For instance, a number of addresses can be grouped into a primitive. A primitive, as described herein, refers to circuitry associated with a number of nozzles.

Firing chambers can be associated with an address to eject fluid. The firing chambers can be fired in a particular firing order. However, due to various practical considerations, rarely, if ever, are all of the nozzles arranged in a primitive, let alone all nozzles in a printhead, fired at the same time while printing a print job and/or a portion of a print job (e.g., a page and/or pages of a print job). For instance, firing all nozzles at the same time may result in an excess of fluid being applied to a print substrate, undesired fluid placement, and/or undesired physical change(s) to the print substrate (e.g., the print substrate becoming saturated with fluid).

Despite every nozzle of the plurality of nozzles included in a primitive not being used at a given time, data, for instance, firing reservations, may be sent to each nozzle of the plurality of nozzles arranged in a primitive(s)(e.g., sent to every pixel row). For instance, such data may be sent for a given firing sequence (e.g., before printing a page of a print job corresponding to the given firing sequence) and/or a given time. In this way, each nozzle of the plurality of nozzles has a predetermined firing reservation and can either be fired or not fired at a time associated with the firing reservations. Such an approach may have a large amount of circuitry and/or a large number of firing reservations due to sending firing reservations to each of the nozzles, regardless of whether or not the nozzle is fired during a print job and/or firing cycle.

Moreover, even though not every nozzle of the plurality of nozzles included in a primitive is used (e.g., fired) at a given time, a respective primitive can experience a relatively high amount of use compared to another primitive at a given time (e.g., during printing of a print job). For example, a primitive (e.g., a primitive having nozzles associated with black ink) may experience comparatively higher use, such as firing a greater number of nozzles arranged thereon and/or firing nozzles more often than another primitive. Accounting for such varied demands on respective primitives, particularly during printing of a print job can be difficult and/or ineffective.

In addition, the above approach of sending firing reservations to each nozzle regardless of whether it is ultimately fired (e.g., fired as part of printing a print job) may result in undesirably predictable non-simultaneous nozzle firing such that a target location of each dot produced by a nozzle on the page is fixed regardless of changes in content to be printed. Techniques such as nozzle "stagger" may attempt to account for such undesirably predictable non-simultaneous nozzle firing, for example, by firing nozzles to allow each nozzle, in turn, to be fired at an intended target location (e.g., directly at the center of its intended pixel). However, such techniques may have undesired effects such as a dot placement error (e.g., an error in placement of a dot from an intended target location), be complex and/or ineffective, among other disadvantages. For example, a dot placement error may be proportional to a timing spread or other factors associated with the nozzle firings of the above techniques.

In contrast, examples of the present disclosure include methods, systems, drive circuits, and computer-readable and executable instructions for assigning firing reservations to primitives. Assigning firing reservations to primitives can refer to assigning a plurality of firing reservations to each of the plurality of primitives and reassigning a firing reservation of the plurality of firing reservations from a primitive of the plurality of primitives to another primitive of the plurality of primitives. A total number of the firing reservations assigned to the plurality of primitives (e.g., each of the plurality of primitives) can, for example, be no more than the peak number of the selected nozzles. Advantageously, assigning firing reservations to primitives allows a firing sequence of a plurality of nozzles to vary for each firing cycle (e.g., each page of a print job) and/or utilizes a comparatively smaller amount of firing reservations (e.g., bandwidth) and/or circuitry (e.g., FET circuits) than other approaches, among other advantages.

Additional advantages can be realized by reassigning firing reservations, as described herein. Reassigning firing reservations (e.g., during printing) can enable maintaining a particular ratio of selected nozzles per primitive and/or firing reservations per primitive. A primitive can include to a threshold amount of area (e.g., nozzle space) of circuitry associated with a number of nozzles. The threshold amount of area can for example be referred to as A (threshold amount of area)=$2^{\wedge N}$; where N is a variable chosen upon a desired circuit size, a desired printing speed, and/or a desired amount of power (e.g., a upper bound of an amount of power capable of being applied to nozzles associated with circuitry of the primitive). For example, a firing reservation assigned to a primitive can be reassigned to another primitive (having a different area not including an area of the primitive).

Such reassignment can occur in response to a respective peak number of selected nozzles arranged in the another primitive being determined to be at least equal to a threshold number of selected nozzles per primitive. By way of example, a primitive having seven selected nozzles to print a portion of a print job can exceed an example of a threshold ratio (e.g., a threshold ratio of 4 selected nozzles per primitive). In such an example, a firing reservation assigned to a primitive that does not exceed the threshold ratio can be reassigned to the primitive that exceeds the threshold ratio. In this manner, a primitive exceeding a threshold number of selected nozzles can effective have "extra" firing reservations (i.e., firing reservations in excess of those originally assigned to the primitive) reassigned thereto. Reassignment can, for example, continue until a number of selected nozzles of a primitive that exceeded a threshold ratio no longer exceeds the threshold ratio. Such reassignment can promote efficient printing and/or reduce an amount of time to print a particular portion of a print job, in contrast to some other approaches such as those detailed above.

FIG. 1 is a block diagram illustrating a printer implementing an example of a printhead for assigning firing reservations to primitives according to the present disclosure. Referring to FIG. 1, a printer 143 (e.g., an inkjet printer) includes a printbar 115 spanning the width of a print substrate 138, flow regulators 140 associated with the printbar 115, a substrate transport mechanism 142, ink or other printing fluid supplies 144, and a printer controller 146.

The print controller 146 represents programming, processor(s) and associated memories, electronic circuitry, and/or other components to control operative elements (e.g., a printhead 117) of the printer 143. The print controller 146 can control various operations of the printer 143. The print controller 146 can be defined by or include a processor resource configured to operate in accordance with a machine-readable program code, an ASIC, a state machine, and so on. Other constituency can also be used. The print controller 146 includes circuitry (not shown), having one or more resources in accordance with the present teachings. The print controller 146 thus includes circuitry of the present teachings directed to assigning firing reservations to primitives.

The printbar 115 includes an arrangement of printheads 117 to dispense printing fluid on to a sheet or continuous web of paper or other print substrate 138. As described in detail below, each printhead 117 includes a plurality of nozzles 145 arranged in arranged in a plurality of primitives (not depicted on FIG. 1 for ease of illustration). While FIG. 1 illustrates a page wide printbar 115 including three printheads 117 the present disclosure is not so limited. That is, the print bar can span an area greater than or less than a print substrate and/or include fewer (e.g., one) or more than the three printheads illustrated in FIG. 1 to promote assigning firing reservations to primitives.

The printhead 117 can be formed of semiconductor material (e.g., silicon) and can include integrated circuitry (e.g., transistors, resistors, etc.). Each printhead 117 includes fluid feed holes, thin-film layer (including firing chambers), and conductors. A slot feeds printing fluid directly to the printhead (e.g., printhead die(s)), such as to fluid feed hole(s) included in the printhead 117. The fluid feed holes provide printing fluid (e.g., ink) to fluid ejectors formed in the thin-film layer. Each printhead 117 includes an ejection chamber and a corresponding orifice through which printing fluid is ejected from the ejection chamber.

Each printhead 117 receives printing fluid through a flow path from the printing fluid supplies 144 into and through the flow regulators 140 and slot(s) 116 in printbar 115 to fluid feed hole(s) (not shown) included in the printhead 117. The printing fluid can be ejected from a plurality of nozzles 145, as described herein, arranged in a primitive that is included in a printhead 117.

Figure 2:
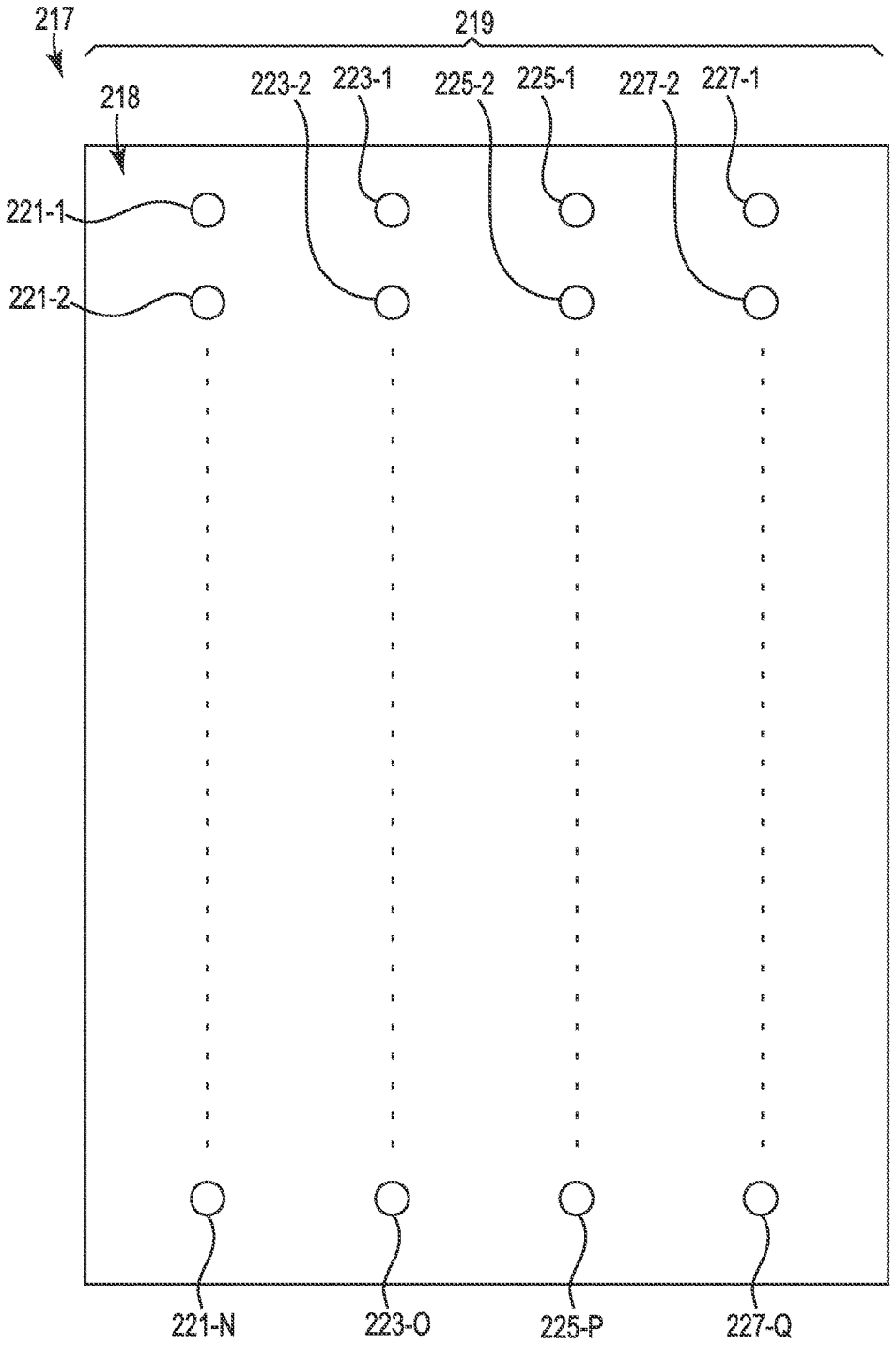
FIG. 2 is a plan view illustrating an example of a portion of a printhead for assigning firing reservations to primitives according to the present disclosure.

FIG. 2 is a plan view illustrating an example of a printhead for assigning firing reservations to primitives according to the present disclosure. Specifically, FIG. 2 illustrates a printhead 217 including a primitive 218 having a plurality of nozzles 219 arranged therein. The primitive 218 can include between 32-112 nozzles per primitive. For example, a primitive can include 96 nozzles arranged therein, in contrast to other primitives which may be limited to no more than 20 nozzles per primitive due to firing/timing constraints associated with relying upon sending firing reservations to each of a plurality of nozzles in the primitive to print a print job regardless of whether a particular nozzle is fired to print the print job. Advantageously, having a greater number of addresses per primitive, compared to approaches that rely upon sending firing reservations to each of a plurality of nozzles regardless of whether the nozzle is to be fired, can result in comparatively smaller amount of data being used to print a print job. Such a reduction in data can translate to relatively smaller circuit interconnects between the nozzles and other electrical components, among other advantages. Additional advantages can be realized by having more than one address assigned per nozzle and/or sending blanks to some but not all of the plurality of nozzles, for example, sending blanks to some of the nozzles to reduce cross-talk.

The plurality of nozzles 219 can be arranged in the primitive 218 in parallel sets of nozzles (e.g., columns of nozzles), for example. The plurality of nozzles 219, as illustrated in FIG. 2, are arranged into four respective sets of nozzles illustrated as including nozzles 221-1, 221-2, . . . , 221-N; 223-1, 223-2, . . . , 223-0; 225-1, 225-2, . . . , 225-P; and 227-1, 227-2, . . . , 227-Q, respectively. Each set of nozzles can correspond to a particular color of fluid (e.g., black ink) and/or can correspond to a respective primitive. For example, the four sets described above can correspond to black, cyan, yellow, and magenta colored fluids, respectively. Other arrangements including providing more or less colors of fluid to more or less sets of nozzles are possible.

The plurality of nozzles 219 can be arranged in multiple columns and/or no columns, staggered or not staggered depending on a design of the nozzles. More specifically, examples are not limited to column, parallel columns, etc. That is, while FIG. 2 illustrates a single primitive having four sets of nozzles the present disclosure is not so limited. Rather, each set of nozzles can be arranged in a respective primitive, among other possible arrangements. For example, a single color (e.g., a black fluid) can be provided to each of the nozzles. In some examples, the plurality of nozzles are not staggered. In some examples, a first set of selected nozzles can corresponds to a first color, where a second set of selected nozzles can corresponds to a second color, and where the first color and the second color are different colors included in a plurality of colors. The printhead 217 can include a suitable number of primitive(s), set(s) of nozzles, and/or be provided suitable color(s) of fluid, among other features to promote assigning firing reservations to primitives.

The plurality of nozzles 219 can each be designated by an address. A set of addresses can make up a primitive. For example, a primitive can include 20 addresses that can each designates a nozzle location. While a single primitive 218 is illustrated in FIG. 2, a printhead can include a number of primitives such as described with respect to FIG. 3. A printbar can be designed to connect with a printer through electrical interconnects (not shown), etc. that provide power and/or data to the printhead 217.

The nozzles can each be associated with a firing chamber (not shown). The plurality of nozzles 219 can be arranged in a particular order and/or can be fired in a particular order. For example, a printhead with a plurality of nozzles including four sets of four nozzles, represented by 1, 2, 3, and 4, associated with respective colors, represented by K, C, M, and Y, respectively, is shown in Table 1. The "peak n", illustrated in Table 1 and Table 2 below, refers to a threshold (e.g., maximum) number of nozzles arranged in a primitive that are sent a firing reservation during a firing cycle (e.g., before printing a page of a print job). As shown Table 1, the peak n is equal to a total number of the plurality of nozzles and coincides with a comparatively greater amount of data being sent to the printhead in contrast to assigning firing reservations to primitives, as described herein. The greater amount of data may employ a greater amount of costly circuitry than an amount of circuitry associated with assigning firing reservations to primitives when transmitting data and/or power to/from the nozzles.

Moreover, data associated with approaches that send firing reservations to each of the plurality of nozzles may not be sent to the nozzles in the same order as the nozzle firing on the printhead, but rather in an unchanging predetermined order (e.g., beginning with a nozzle represented by K1 and progressing successively for each nozzle to the right until reaching the nozzle represented by Y4) which located in memory (hard-wired) into the printhead circuits. For example, the firing order may employ sending zeros (e.g., blanks), corresponding to firing reservations that are not used to fire a nozzle receiving the zero, to each of a number of non-firing nozzles included in a plurality of nozzles.

TABLE 1

| Peak n | | | | | 16 | | | | | | | | | | | |
|---|---|---|---|---|---|---|---|---|---|---|---|---|---|---|---|---|
| Predetermined Data Order | K 1 | K 2 | K 3 | K 4 | C 1 | C 2 | C 3 | C 4 | M 1 | M 2 | M 3 | M 4 | Y 1 | Y 2 | Y 3 | Y 4 |
| Actual Data | 1 | 1 | 1 | 1 | 0 | 0 | 0 | 0 | 0 | 0 | 0 | 0 | 0 | 0 | 0 | 0 |

Table 1 displays information corresponding to an example of data sent to a printhead including four sets of four nozzles per respective color to print a print job. More specifically, Table 1 displays the comparatively greater amount of data overhead (e.g., sending firing reservations to each of a plurality of nozzles) represented by a peak n of 16. Note that zeros are sent to all non-firing nozzles. The zeros correspond to firing reservations sent to nozzles that are not fired. Such sending of data can be associated with extra circuitry and/or difficulties associated with unchanging predetermined data transmission order. Such difficulties are avoided with assigning firing reservations to primitives, as described herein.

Assigning firing reservations to primitives can include selecting a firing order of the selected nozzles. For example, the fire order can be based upon a number of considerations including ensuring a desired amount of color separation between different colors of fluid, ensuring a desired amount of color separation within a particular color of fluid (e.g., separation between ejections of fluid of two or more nozzles printing the same color of fluid), among other considerations. In some examples, the firing order can include sending a number of zero(s) in firing reservations associated with the selected nozzles, for instance, to minimize cross-talk among the selected nozzles.

TABLE 2

| Peak n | | | 8 | | | | | |
|---|---|---|---|---|---|---|---|---|
| Actual Data | C1-0 | M1-0 | K1-1 | K3-1 | K2-1 | K4-1 | Y1-0 | K1-0 |

Table 2 displays information corresponding to an example of data sent to a printhead including four sets of four nozzles per color using an example of selecting nozzles to print a print job (the same print job as referenced in Table 1). Table 2 displays, an example of selecting nozzles where a peak n is determined to be 8. The present disclosure is not so limited. The peak n can be determined to be a value less than a total number of the plurality of nozzles. Notably, with the peak n of 8, even when all 8 firing reservations are sent to the selected nozzles still uses only half of the 16 firing reservations utilized in Table 1. Note that zeros are only sent to some of the nozzles that are not fired for a particular print job and/or firing sequence. This reduction in firing reservations corresponds to a reduction in data sent to the printhead that can enable a comparatively smaller amount of circuitry to be associated with the printhead, among other benefits. Further advantages can be realized by assignment (e.g., reassignment) of firing reservations to primitives, as described herein.

Figure 3:
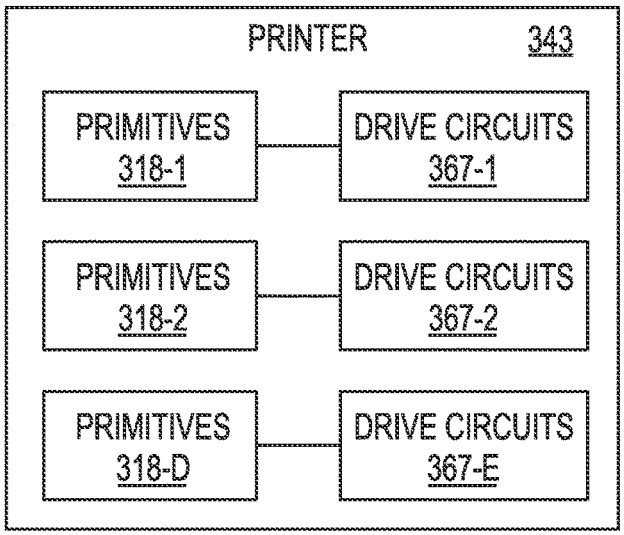
FIG. 3 illustrates a block diagram of an example of a rudimentary printer according to the present disclosure.

FIG. 3 illustrates a block diagram of an example of a rudimentary printer 343. The printer may be analogous to printing device 143 described with respect to FIG. 1. The printing device 343 may be an inkjet-printing device, such as a printer, that ejects fluid onto media, such as paper, to form images, which can include text, on the media. Drive circuits 367-1, 367-2, . . . , 367-E may be analogous to drive circuit 218 and/or primitives 318-1, 318-2, . . . , 318-D may be analogous to primitive 218.

The printing device 343 (e.g., a piezoelectric inkjet printhead) includes a plurality of ejection nozzles, such as those described herein, and corresponding drive circuits. Each drive circuit (e.g., a controller) of the drive circuits 367-1, . . . , 367-E can correspond to a single nozzle of the plurality of ejection nozzles arranged in primitives 318-1, 318-2, . . . , 318-D, although each ejection nozzle of the plurality of nozzles may have more than one drive circuit.

The drive circuits 367-1, . . . , 367-E may be analogous to the controller described with respect to FIG. 1 and/or may be implemented on a circuit layer of the printhead. As a particular example, a drive circuit (e.g., 367-1) may reside as part of a complementary metal-oxide semiconductor (CMOS) layer of the printhead. The drive circuits 367-1, . . . , 367-E can produce an ejection waveform(s) that can be applied globally (e.g., a golden waveform) or to individual ejection nozzles, for example, though use of a voltage scale memory (not shown), a voltage scale (not shown), an arbitrary waveform generator (AWG) (not shown), an amplifier (not shown), a lookup table (not shown), a digital to analogue converter (DAC) (not shown), and/or a protective ground (PGND) (not shown), among other possible components to promote nozzle selection. An ejection waveform can be sent to a selected nozzle to cause the selected nozzle to fire. For instance, the ejection waveform(s) can be sent to a selected nozzle(s) in a particular firing order, such as those described herein.

Each of the primitives 318-1, . . . , 318-D can have a peak number of selected nozzles arranged therein to print a portion of print job determined, as described herein. For example, a peak number of selected nozzles arranged in primitive 318-1 can be determined and/or a peak number of selected nozzles arranged in primitive 318-2 can be determined. While FIG. 3 illustrates three primitives and three drive circuits the present disclosure is not so limited. That is, a printer can include more or less primitives and/or drive circuits, among other components, to promote assigning firing reservations to primitives.

Figure 4:
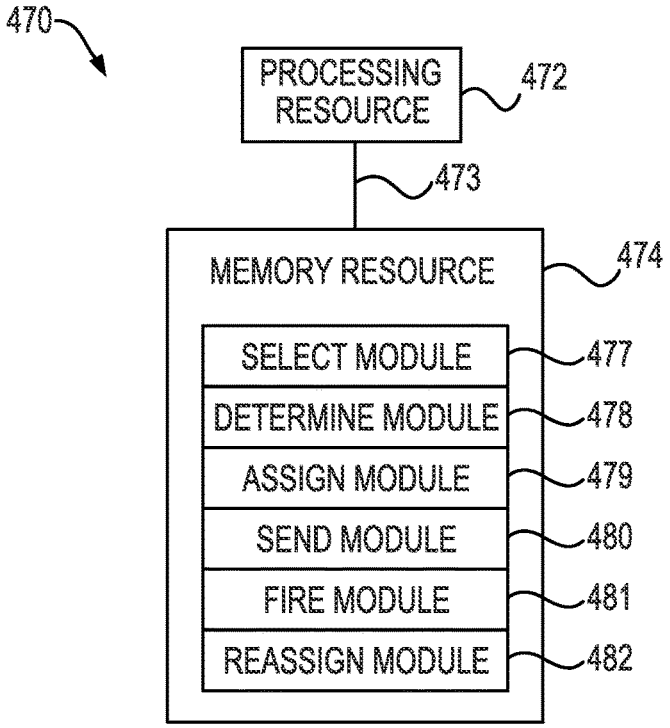
FIG. 4 illustrates a diagram of an example of a system for assigning firing reservations to primitives according to the present disclosure.

FIG. 4 illustrates a diagram of an example of a system 470 for assigning firing reservations to primitives according to the present disclosure. A system 470 can utilize software, hardware, firmware, and/or logic to perform a number of functions. The system 470 can be a combination of hardware and program instructions to assign firing reservations to primitives. The hardware, for example can include a processing resource 472, a memory resource 474 (e.g., computer-readable medium (CRM)). Processing resource 472, as used herein, can include a number of processing resources capable of executing instructions stored by a memory resource 474. Processing resource 472 may be integrated in a single device or distributed across devices. The program instructions (e.g., computer-readable instructions (CRI)) can include instructions stored on the memory resource 474 and executable by the processing resource 472 to implement a desired function (e.g., determining a peak number of selected nozzles arranged in a plurality of primitives to print a portion of print job, etc.).

The memory resource 474 can be in communication with a processing resource 472. A memory resource 474, as used herein, can include a number of memory components capable of storing instructions that can be executed by processing resource 472. Such memory resource 474 can be a non-transitory CRM. Memory resource 474 may be integrated in a single device or distributed across devices. Further, memory resource 474 may be fully or partially integrated in the same device as processing resource 472 or it may be separate but accessible to that device and processing resource 472. The system 470 may be implemented on a printhead, as described herein.

The processing resource 472 can be in communication with a memory resource 474 storing a set of CRI executable by the processing resource 472, as described herein. The CRI can also be stored in remote memory managed by a server and represent an installation package that can be downloaded, installed, and executed.

Processing resource 472 can execute CRI that can be stored on an internal or external memory resource 474. The processing resource 472 can execute CRI to perform various functions, including the functions described herein. For example, the processing resource 472 can execute CRI to select nozzles of a plurality of nozzles arranged in a plurality of primitives based on content of a print job to print the print job.

The CRI can include a number of modules 477, 478, 479, 480, 481, 482. The number of modules 477, 478, 479, 480, 481, 482, can include CRI that when executed by the processing resource 472 can perform a number of functions. The number of modules 477, 478, 479, 480, 481, 482 can be sub-modules of other modules. For example, a select module 477 and a determine module 478 can be sub-modules and/or contained within the same computing device. In another example, the number of modules 477, 478, 479, 480, 481, 482 can include individual modules at separate and distinct locations (e.g., CRM, etc.).

A select module 477 can include CRI that when executed by the processing resource 472 can perform a number of selecting functions. The select module 477 can include instructions to select nozzles of a plurality of nozzles arranged in a plurality of primitives to print a portion of a print job. For instance, such selection can be based on content of the print job. The instructions can, for example, be stored in an internal or external non-transitory CRM coupled to the printing device (e.g., the printer 343 as illustrated in FIG. 3) that can execute instructions stored in the internal or non-transitory external CRM.

The system can include a determine module 478. A determine module 478 can include CRI that when executed by the processing resource 472 can provide a number of determining functions. The determine module 478 can determine a respective peak number of the selected nozzles arranged in each primitive, as described herein, of the plurality of primitives to print the print job An assign module 479 can include CRI that when executed by the processing resource 472 can perform a number of assigning functions. An assign module 479 can assign a number of firing reservations to a first set of addresses associated with a first set of the selected nozzles, for instance, where a total number of the firing reservations (the firing reservations assigned) is no more than the peak number of the selected nozzles. The assign module 479 can assign a plurality of firing reservations to each of a plurality of primitives. For examples, assignment where a total number of the firing reservations assigned to each primitive of the plurality of primitives at a given time is comparatively less than a greatest respective peak number of the selected nozzles determined for each of the plurality of primitives.

The system can include a send module 480. The send module can send firing data to the plurality of nozzles. For instance, the send module 480 can send firing data to the first set of selected nozzles to reduce an amount of firing data sent to the plurality of nozzles. In some examples, the send module 480 can send firing data to the selected nozzles that can include a sequence of firing data sent to at least two of the first set of selected nozzles simultaneously. For example, a sequence of firing data can be sent to a nozzle and another nozzle in a first set of selected nozzles (e.g., the nozzle and the another nozzle both corresponding to a black color). Notably, firing data can be sent only to the selected nozzles, not non-selected nozzles included in the plurality of nozzles. For instance, firing data can be sent only to the first set of selected nozzles for a particular portion of a print job. Again, this can promote a desirable reduction in an amount of firing data sent to a printhead.

A fire module 481 can include CRI that when executed by the processing resource 472 can perform a number of firing functions. Fire module 481 can fire the first set of the selected nozzles based on the firing data to print a portion of the print job (e.g., a page of a print job).

The system can include a reassign module 482. The reassign module 482 can reassign at least some of the firing reservations to another primitive including second set of addresses associated with a second set of the selected nozzles. For instance, such reassignment can be in response to a respective peak number of number of selected nozzles arranged in the another primitive being determined to be at least equal to a threshold number of nozzles and/or in response to firing the first set of the selected nozzles. Described another way, reassignment can include reassigning a firing reservation of the plurality of firing reservations from a primitive of a plurality of primitives having comparatively less selected nozzles at a given time to another primitive of the plurality of primitives having comparatively more selected nozzles at the given time during printing of a print job.

Reassignment can facilitate shifting firing reservations between selected nozzles arranged on primitives during the course of printing a print job and/or prior to printing a print job, for instance, to reduce an amount of firing data (e.g., firing reservations) sent to the plurality of nozzles, provide comparatively faster printing by shifting firing reservations to primitives with a comparatively high peak number of selected nozzles, and/or reduce the amount of fluidic cross-talk, among other advantages.

The system can include an analyze module (not shown). An analyze module can include CRI that when executed by the processing resource 472 can prepare content of a print job sent to a printer including a printheads each having a plurality of nozzles arranged in a primitive. The plurality of nozzles can include a total number of the plurality of nozzles in a range of from 32 nozzles to 128 nozzles arranged in the primitive, however, the total number of nozzle arranged in a primitive can be vary to promote assigning firing reservations to primitives.

The memory resource 474 can be integral, or communicatively coupled, to a computing device, in a wired and/or a wireless manner. For example, the memory resource 474 can be an internal memory, a portable memory, a portable disk, or a memory associated with another computing resource (e.g., enabling CRIs to be transferred and/or executed across a network such as the Internet).

The memory resource 474 can be in communication with the processing resource 472 via a communication path 473. The communication path 473 can be local or remote to a computing device) associated with the processing resource 472. Examples of a local communication path 473 can include an electronic bus internal to a computing device where the memory resource 474 is one of volatile, non-volatile, fixed, and/or removable storage medium in communication with the processing resource 472 via the electronic bus.

The communication path 473 can be such that the memory resource 474 is remote from the processing resource (e.g., 472), such as in a network connection between the memory resource 474 and the processing resource (e.g., 472). That is, the communication path 473 can be a network connection. Examples of such a network connection can include a local area network (LAN), wide area network (WAN), personal area network (PAN), and the Internet, among others. In such examples, the memory resource 474 can be associated with a first computing device and the processing resource 472 can be associated with a second computing device (e.g., a Java® server). For example, a processing resource 472 can be in communication with a memory resource 474, where the memory resource 474 includes a set of instructions and where the processing resource 472 is designed to carry out the set of instructions.

Figure 5:
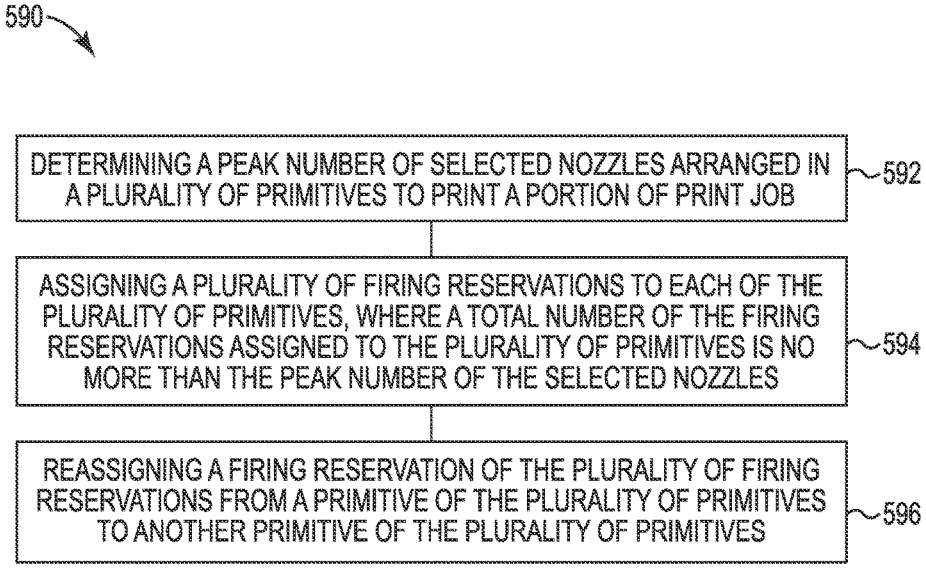
FIG. 5 is an example of a method for assigning firing reservations to primitives according to the present disclosure.

FIG. 5 is an example of a method for assigning firing reservations to primitives according to the present disclosure. As shown at 592, the method 590 can include determining a peak number of selected nozzles arranged in a plurality of primitives to print a portion of print job. In some examples, a respective peak number of the selected nozzles to print each page of the print job can be determined. For example, in a printer including three primitives each including a plurality of nozzles arranged therein, a respective peak number of selected nozzles can be determined for each of the three primitives. A total number of the firing reservations assigned to the each of the plurality of primitives can be the same for each of the plurality of primitives, however, a total number of primitives assigned to each primitive can be different from a primitive to another primitive of the plurality of primitives.

In some examples, a ratio of a total number of selected nozzles per primitive can be determined for each page in a print job. That is, the peak number can be equal to a total number of firing reservations sent to the selected nozzles per firing cycle. Such determining can occur successively during printing of the print job, for instance, for each successive page of a print job. Advantageously, assigning firing reservations to primitives can promote a comparatively low ratio of selected nozzles per primitive in contrast to other approaches that send data to each nozzle for each firing sequence.

The method 590 can, in some examples, include analyzing content of a print job sent to a printer, for instance, where the printer includes a printhead (e.g., a print head included in a printbar) having a plurality of nozzles arranged a plurality of primitives. For example, content included in a print job, such as each of a number of pages included in the print job can be analyzed prior to printing the print job. Such analyzing can include analyzing page dot density (e.g., a dot distribution map) of the print job, among other data included in a print job. The print job can be analyzed while in a printing queue, for example, in a printing queue including a number of print jobs to be printed and/or can be analyzed during spooling of the print job, among other suitable times before printing. Such analyzing can promote assignment and/or reassignment of firing reservations, as described herein.

The method 590 can include assigning a plurality of firing reservations to each of the plurality of primitives, where a total number of the firing reservations assigned to the plurality of primitives is no more than the peak number of the selected nozzles, as shown at 594.

The method can include selection selecting nozzles to print some or all of a print job. For example, a plurality of nozzles at locations that correspond (e.g., map) to target locations on a print substrate for producing a desired images(s) can be selected. For instance, in some examples, selecting nozzles can include selecting some but not all of the plurality of nozzles arranged in the primitive. In this manner, a plurality of selected nozzles can be fired in a particular firing order that can vary during printing of a print job and/or between different print jobs.

The method can include assigning firing reservations to the selected nozzles. For example, a total number of the firing reservations assigned to the selected nozzles can be comparatively less than a total number of the plurality of nozzles. For instance, in some examples, the total number of the firing reservations assigned can be no more than (e.g., equal) to a peak number of the selected nozzles arranged in a plurality of primitives to print a portion of print job, during printing of the print job (e.g., during a particular firing sequence of the print job). A time associated with the peak number of the selected nozzles can correspond to a time associated with a peak amount of data (e.g., a peak number of firing reservations including firing instructions to fire/not fire each of the selected nozzles) sent to the plurality of nozzles arranged in primitives. Again, such a peak amount of data is comparatively less than an amount of data associated with sending firing reservations to each of the plurality of nozzles (e.g. for each given firing sequence).

The method 590 can, in some examples, include assigning firing reservations across a plurality of sets of nozzles. That is, the selected nozzles can include a plurality of sets of nozzles. For example, as described with respect to FIG. 2 in greater detail, a plurality of selected nozzles can include a plurality of sets of nozzles such that each set can have a respective color (e.g., black, cyan, yellow, and magenta colored fluids) associated therewith. Advantageously and in contrast to approaches that assign firing reservations to each nozzle, assigning firing reservations across a plurality of sets of nozzles (e.g., selected nozzles) can comparatively reduce a number of firing reservations sent to the plurality of nozzles and/or enable firing reservations (e.g., a peak number of firing reservations) to be reassigned (e.g., shifted) between the plurality of set of nozzles and/or between a plurality of primitives in which the nozzles are arranged.

For example, if a particular print job and/or particular page of a print job does not include a color(s) associated with a respective set(s) of nozzles then firing reservations can be shifted away from that set of nozzles to other sets of nozzles that have a respective color associated therewith that is included in the print job and/or a particular page of a print job. Such assignment of firing reservations across a plurality of sets of nozzles can reduce an amount of data (e.g., an overall number of firing reservations sent during a firing sequence) to a plurality of nozzle during a given firing sequence of a print job and/or over the course of the entire print job, among other advantages.

In some examples, the method 590 can include sending firing data to the selected nozzles assigned firing reservations in an order in the same order as a firing order of the selected nozzles. Firing data can include firing instructions (e.g., a "1" to fire a nozzle and/or a "0" to not fire a nozzle), a location corresponding to a nozzle (e.g., a row and/or column), and/or a firing order, as described herein. For example, firing instructions can, in some examples, include a row and/or a column corresponding to a respective address associated with a selected nozzle of the selected nozzles (e.g., of each of the selected nozzles assigned firing reservations).

The method 590 can include selecting a firing order of the selected nozzles, for instance, selecting a firing order of selected nozzles assigned firing reservations. A firing order refers to a number of times (e.g., a sequence of times), for example corresponding to a firing sequence during printing of a print job, in which the plurality of selected nozzles are fired and/or not fired at a particular time depending upon a firing instruction sent to a particular selected nozzle of the plurality of selected nozzles. A firing order can be selected in response to selecting nozzles of the plurality of nozzles to print the print job based on the content of the print job, for example.

The method 590 can include sending firing data, for example, firing data including the firing order, to the each of the selected nozzles assigned firing reservations. For instance, the firing data can be sent in the same order as the firing order of the selected nozzles assigned firing reservations. Firing data (e.g., firing instructions to fire or not fire a particular selected nozzle) can be transmitted only to the selected nozzles, not to non-selected nozzles included in the plurality of nozzles and/or not to selected nozzles that do not fire for a particular firing sequence (e.g., non-firing nozzles for a particular page of a print job). Non-selected nozzles refer to nozzle of the plurality of nozzles that do not eject fluid during printing of the print job.

In some examples, firing data can include a respective firing instruction for each of the selected nozzles assigned firing reservations. Such respective firing instructions can include a firing instruction corresponding to a blank (e.g., a "0" and/or a combination of multiple "0"s) that can be assigned to a selected nozzle. Such firing instructions to not fire (e.g., a blank) can be introduced into a particular firing cycle for a variety of purposes including reducing cross-talk. Selected nozzles that do not fire for a particular sequence can be fired for a different firing sequence (e.g., a different firing sequence corresponding to a different page and/or target location on a page) during printing of a print job. In some examples, respective firing instruction for each of the selected nozzles assigned firing reservations includes a firing instruction corresponding to a blank for a selected nozzle As shown at 596, the method 590 can include reassigning a firing reservation of the plurality of firing reservations from a primitive of the plurality of primitives to another primitive of the plurality of primitives during printing of a print job. Reassigning the firing instructions can occur during printing of a print job, for instance, during a print sweep. A firing reservation and/or a plurality of firing reservations can be reassigned, for example, reassigned prior to printing a page of a print job. For example, a firing reservation can be reassigned from a primitive (e.g., prior printing a first page of a print job) to another primitive (e.g., prior to printing a second page of the print job) during printing of a print job. Advantageously, reassigning during printing can enable maintaining a particular ratio of selected nozzles per primitive and/or firing reservations per primitive.

The figures herein follow a numbering convention in which the first digit or digits correspond to the drawing figure number and the remaining digits identify an element or component in the drawing. As will be appreciated, elements shown in the various examples herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can refer to one or more of such elements and/or features. In addition, "for example" and similar phrasing is intended to mean, "by way of example and not by way of limitation".

The specification examples provide a description of the applications and use of the system and method of the present disclosure. Since many examples can be made without departing from the spirit and scope of the system and method of the present disclosure, this specification sets forth some of the many possible example configurations and implementations.

What is claimed:

1. A method for assigning firing reservations to primitives, comprising:

determining a peak number of selected nozzles arranged in a plurality of primitives to print a portion of print job, assigning a plurality of firing reservations to each of the plurality of primitives, wherein a total number of the firing reservations assigned to the plurality of primitives is no more than the peak number of the selected nozzles, wherein the peak number of the selected nozzles per firing cycle is equal to a total number of firing reservations sent to the selected nozzles per firing cycle; and reassigning a firing reservation of the plurality of firing reservations from a primitive of the plurality of primitives to another primitive of the plurality of primitives.

2. The method of claim 1, wherein a respective peak number of the selected nozzles to print each page of the print job is determined.

3. The method of claim 1, where reassigning the firing reservations occurs during printing of the print job.

4. The method of claim 1, wherein the selected nozzles include a plurality of sets of nozzles, wherein assigning the firing reservations includes assigning the firing reservations across the plurality of sets of nozzles, and wherein each set of nozzles has a respective color associated therewith.

5. The method of claim 1, further comprising:

analyzing a content of the print job; and selecting the selected nozzles based on the analyzing of the content of the print job.

6. The method of claim 5, wherein analyzing the content comprises analyzing a page dot density of the print job.

7. The method of claim 1, wherein the peak number is determined to be a value less than a total number of a plurality of nozzles in the plurality of primitives.

8. A drive circuit including logic, embedded in an application specific integrated circuit (ASIC) to control a printhead having a plurality of nozzles arranged in a plurality of primitives, the drive circuit to:

select nozzles of a plurality of nozzles arranged in a plurality of primitives based on content of a print job to print the print job;

determine a respective peak number of the selected nozzles arranged in each primitive of the plurality of primitives to print the print job, the respective peak number determined to be a value less than a total number of the plurality of nozzles;

assign a plurality of firing reservations to each of a plurality of primitives, wherein a total number of the firing reservations assigned to each primitive of the plurality of primitives at a given time is comparatively less than a greatest respective peak number of the selected nozzles; and reassign a firing reservation of the plurality of firing reservations from a primitive of the plurality of primitives having comparatively less selected nozzles at a given time to another primitive of the plurality of primitives having comparatively more selected nozzles at the given time during printing of the print job.

9. The drive circuit of claim 8, wherein a total number of the firing reservations assigned to the each of the plurality of primitives is the same for each of the plurality of primitives.

10. The drive circuit of claim 8, wherein a total number of the firing reservations assigned to the each of the plurality of primitives varies during printing of the print job.

11. The drive circuit of claim 8, wherein the drive circuit is to send firing data only to the selected nozzles, not non-selected nozzles included in the plurality of nozzles.

12. The drive circuit of claim 8, wherein the firing reservation of the plurality of assigned firing reservations is reassigned prior to printing a page of a print job.

13. The drive circuit of claim 12, wherein the reassigned firing reservation is included in a plurality of firing reservations that are reassigned prior to printing a page of a print job.

14. The drive circuit of claim 8, wherein the peak number of the selected nozzles per firing cycle is equal to a total number of firing reservations sent to the selected nozzles per firing cycle.

15. The drive circuit of claim 8, wherein the reassigning of the at least some of the firing reservations is further in response to a peak number of selected nozzles arranged in the another primitive being determined to be at least equal to a threshold number of the selected nozzles.

16. A system for assigning firing reservations to primitives, the system comprising a processing resource in communication with a memory resource including instructions and the processing resource designed to carry out the instructions to:

select nozzles of a plurality of nozzles arranged in a plurality of primitives to print a portion of a print job;

determine a respective peak number of the selected nozzles arranged in each primitive of the plurality of primitives to print the portion of the print job;

assign a plurality of firing reservations to a primitive including a first set of addresses associated with a first set of the selected nozzles, wherein a total number of the plurality of firing reservations is no more than a comparatively highest respective peak number of the selected nozzles;

send firing data to the first set of the selected nozzles;

fire the first set of the selected nozzles based on the firing data to print the portion of the print job; and reassign at least some of the firing reservations to another primitive including a second set of addresses associated with a second set of the selected nozzles in response to a peak number of selected nozzles arranged in the another primitive being determined to be at least equal to a threshold number of selected nozzles.

17. The system of claim 16, wherein the first set of selected nozzles corresponds to a first color, wherein the second set of selected nozzles corresponds to a second color, and wherein the first color and the second color are different colors included in a plurality of colors.

18. The system of claim 16, wherein a total number of a plurality of nozzles arranged in each of the plurality of primitives is in a range of from 32 nozzles to 128 nozzles.

* * * * *